US009757957B1

(12) United States Patent
Breuer et al.

(10) Patent No.: US 9,757,957 B1
(45) Date of Patent: Sep. 12, 2017

(54) CARTRIDGE LABEL PRINTER FOR A LIBRARY SYSTEM

(71) Applicant: International Business Machines Corporation, Armonk, NY (US)

(72) Inventors: Marcus Breuer, Dalheim (DE); Frank Krick, Ockenheim (DE); Thorsten Muehge, Budenheim (DE); Erik Rueger, Ockenheim (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/230,691

(22) Filed: Aug. 8, 2016

(51) Int. Cl.
*B41J 3/407* (2006.01)
*B41J 2/325* (2006.01)

(52) U.S. Cl.
CPC ..... *B41J 3/4075* (2013.01); *B41J 2/325* (2013.01)

(58) Field of Classification Search
None
See application file for complete search history.

(56) References Cited

U.S. PATENT DOCUMENTS

| | | | |
|---|---|---|---|
| 5,214,768 A | 5/1993 | Martin et al. | |
| 8,262,218 B2 | 9/2012 | Choi et al. | |
| 2004/0141661 A1 | 7/2004 | Hanna et al. | |
| 2005/0041091 A1 | 2/2005 | Sawyer | |
| 2012/0243170 A1 | 9/2012 | Frink et al. | |
| 2014/0138277 A1* | 5/2014 | Raming | G09F 3/0288 206/459.5 |
| 2014/0307279 A1 | 10/2014 | Yasui et al. | |

FOREIGN PATENT DOCUMENTS

| | | |
|---|---|---|
| GB | 2428864 A | 7/2007 |
| JP | 2007317157 A | 12/2007 |
| JP | 5605647 B2 | 10/2014 |
| JP | 2015066894 A | 4/2015 |

OTHER PUBLICATIONS

IBM et al., "Apparatus for Labeling Removable Media Cartridges with Bistable LCD", An IP.com Prior Art Database Technical Disclosure, Original Publication Date: Nov. 11, 2008, IP.com No. IPCOM000176254D, IP.com Electronic Publication Date: Nov. 11, 2008, 4 pages.

Beicht et al., "A Library System With Integrated Label Printer", U.S. Appl. No. 15/230,567, filed Aug. 8, 2016, 40 pages.

IBM Appendix P, list of patents and patent application treated as related, Aug. 8, 2016, 2 pages.

* cited by examiner

*Primary Examiner* — Lisa M Solomon
(74) *Attorney, Agent, or Firm* — Steven F. McDaniel

(57) ABSTRACT

A cartridge label printer is provided for printing and applying a label to a cartridge, such as a tape cartridge in a tape library system. The cartridge label printer includes a housing having a form factor and electrical connectors identical to a tape drive module of the tape library system, and a controller to control functions of the cartridge label printer. The controller is compatible with a communication protocol of the tape drive module. The cartridge label printer further includes a label supply roll comprising individual labels on a carrier tape, an empty carrier tape reception roll, a label printing device adapted for printing a code on the label, a carrier tape transport unit, a label removal unit adapted for a removal of a label from the carrier tape, and a label application unit adapted for applying the label to the cartridge.

15 Claims, 8 Drawing Sheets

CARTRIDGE LABEL PRINTER FOR A LIBRARY SYSTEM

BACKGROUND OF THE INVENTION

The present invention relates generally to the field of label printing, and more specifically, to a cartridge label printer for printing and applying a label to a cartridge of a library system. The invention relates further to a method for operating a cartridge label printer for printing and applying a label to a cartridge.

Typically, magnetic tapes are used as long-term storage media and/or for archiving purposes. The magnetic tapes are typically enclosed in standardized cartridges. In order to differentiate the cartridges by optical pattern recognition, printed labels are typically applied to the cartridges. The labels may be human and/or machine-readable. Today, various vendors generate these labels, and end-users have to manually place them on the cartridges. Even if the labels are specified in quality categories, the machine readability and long term stability of the labels varies from vendor to vendor. Issues with reading a label—and thus, identifying a cartridge—may be time-consuming and can lead to a situation in which data on the magnetic tapes may not be available for users, thereby endangering business continuity and/or operations to restore archived data.

Additionally, manual placement of labels onto the cartridges is time-consuming and error prone. Different users may apply labels on different cartridges in different ways, which makes machine readability more difficult. Furthermore, labels from different vendors are not standardized, having different material characteristics, reflectivity and durability of the code printed on the label.

SUMMARY

According to one aspect of the present invention, a cartridge label printer for printing and applying a label to a cartridge is provided. The cartridge may include a storage medium. The cartridge label printer may comprise a housing having a form factor and electrical connectors identical to a drive module of a library system, and a controller with controlling functions of the cartridge label printer. The controller may be compatible with a communication protocol of the drive module. A cartridge load unit with identical functions, as the drive module, may also be provided. The cartridge label printer may additionally comprise a label supply roll comprising individual labels on a carrier tape, an empty carrier tape reception roll, a label printing device adapted for printing a code on the label, a carrier tape transport unit, a label removal unit adapted for a removal of a label from the carrier tape, and a label application unit adapted for applying the label to the cartridge.

According to another aspect of the present invention, a method for operating a cartridge label printer for printing and applying a label to a cartridge is provided. Such a cartridge may comprise a storage medium. The method may comprise loading the cartridge into the cartridge label printer, receiving label information by a controller, pulling a carrier tape comprising a label from a label supply roll by an empty carrier roll, thereby printing information according to the received label information by passing the label on the carrier tape over a print head. The method may additionally comprise positioning the label in an application position relative to the cartridge by continuously pulling by the empty carrier roll, blocking a feeding of the label supply roll, once the label is in the application position. Thereby, the carrier tape may move a guided label release roller, from a parking position, parallel to a side of the cartridge, thereby increasingly tensioning a spring, such that the label is released from the carrier tape. The label may be applied to the cartridge. Finally, the cartridge may be unloaded from the cartridge label printer.

BRIEF DESCRIPTION OF THE DRAWINGS

It should be noted that embodiments of the invention are described with reference to different subject-matter. In particular, some embodiments are described with reference to method type claims whereas other embodiments have been described with reference to apparatus type claims. However, a person skilled in the art will gather from the above and the following description that, unless otherwise notified, in addition to any combination of features belonging to one type of subject-matter, also any combination between features relating to different subject-matters, in particular, between features of the method type claims, and features of the apparatus type claims, is considered as to be disclosed within this document.

The aspects defined above, and further aspects of the present invention are apparent from the examples of embodiments to be described hereinafter and are explained with reference to the examples of embodiments, but to which the invention is not limited.

Figure 1:
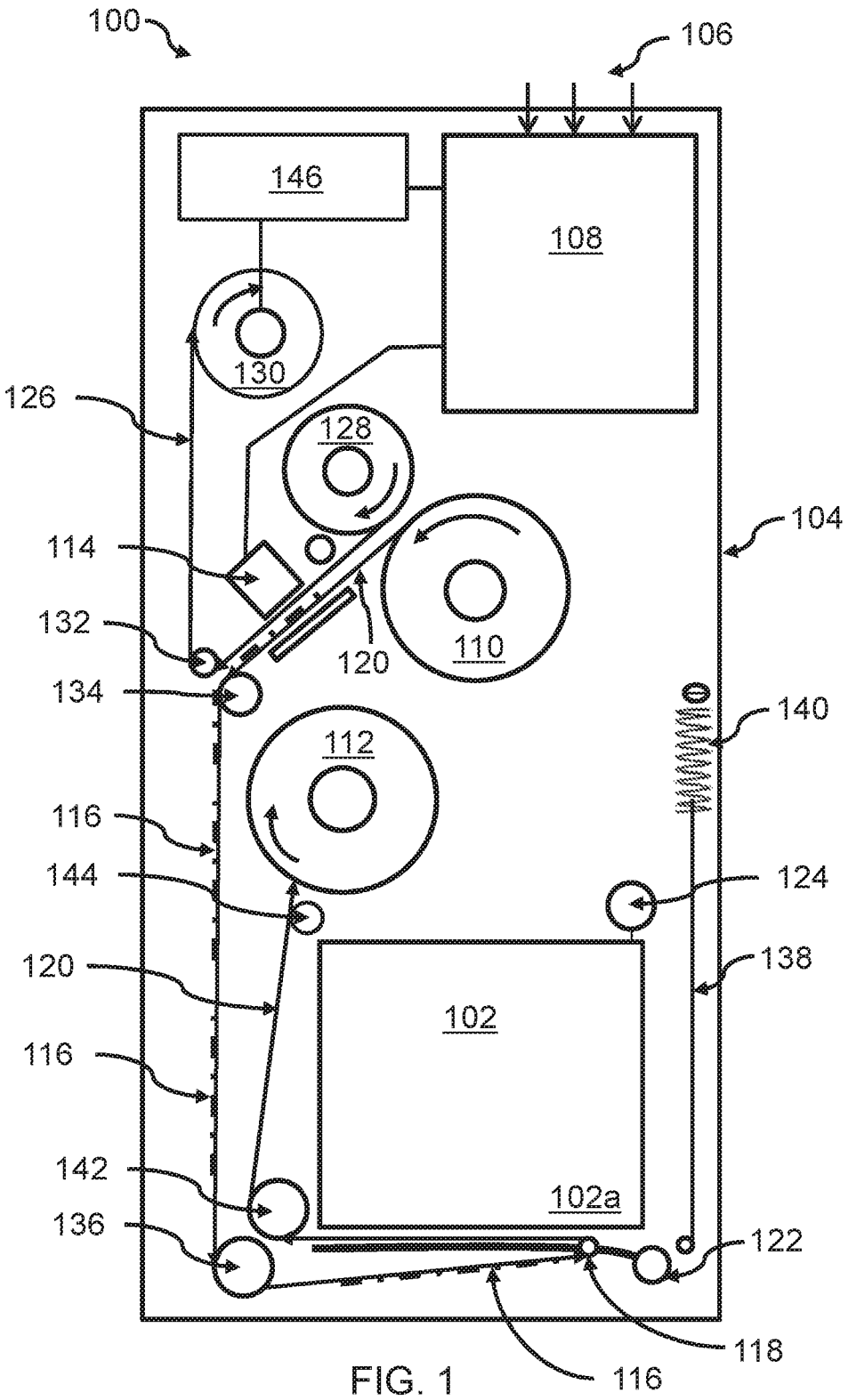
Figure 2:
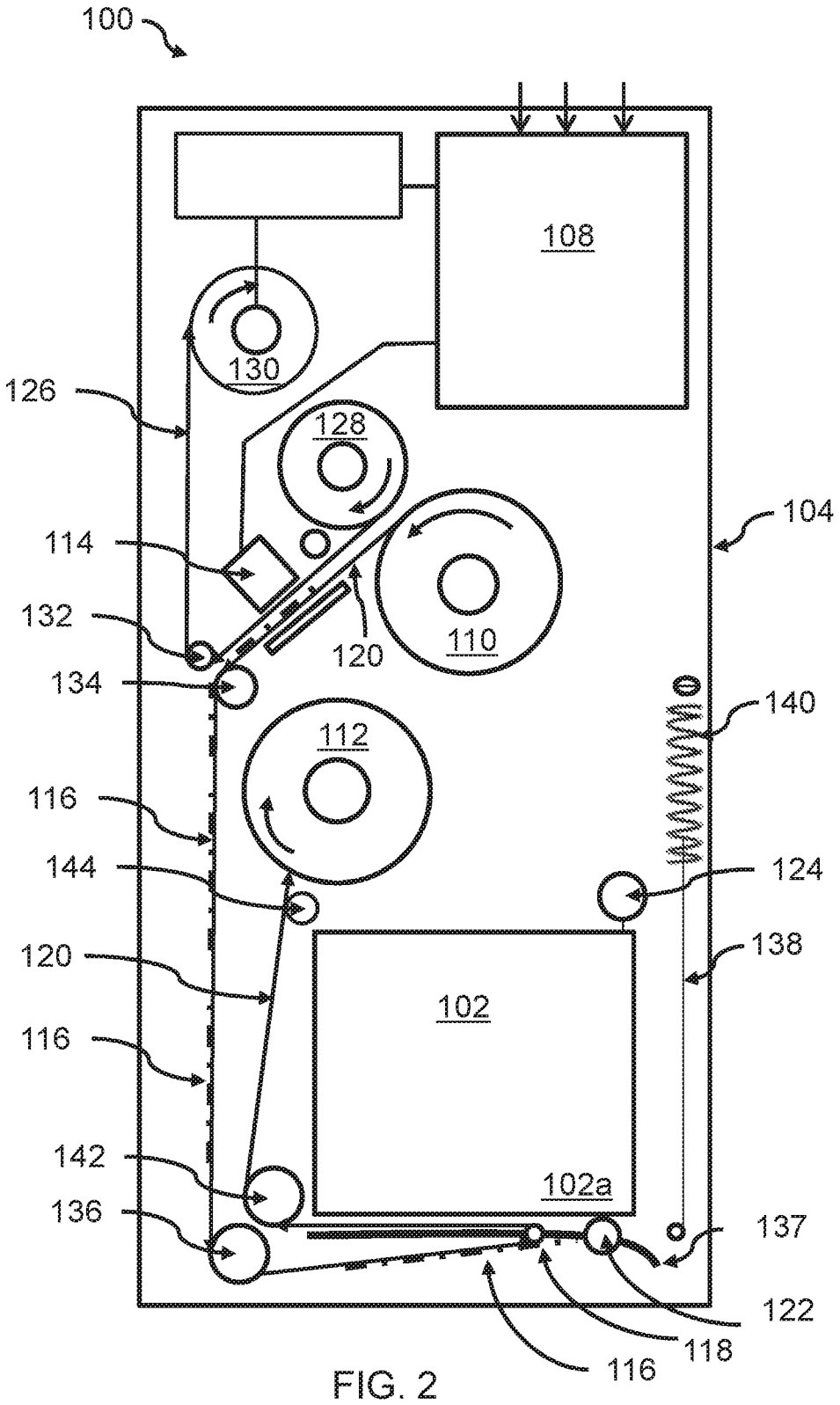
Figure 3:
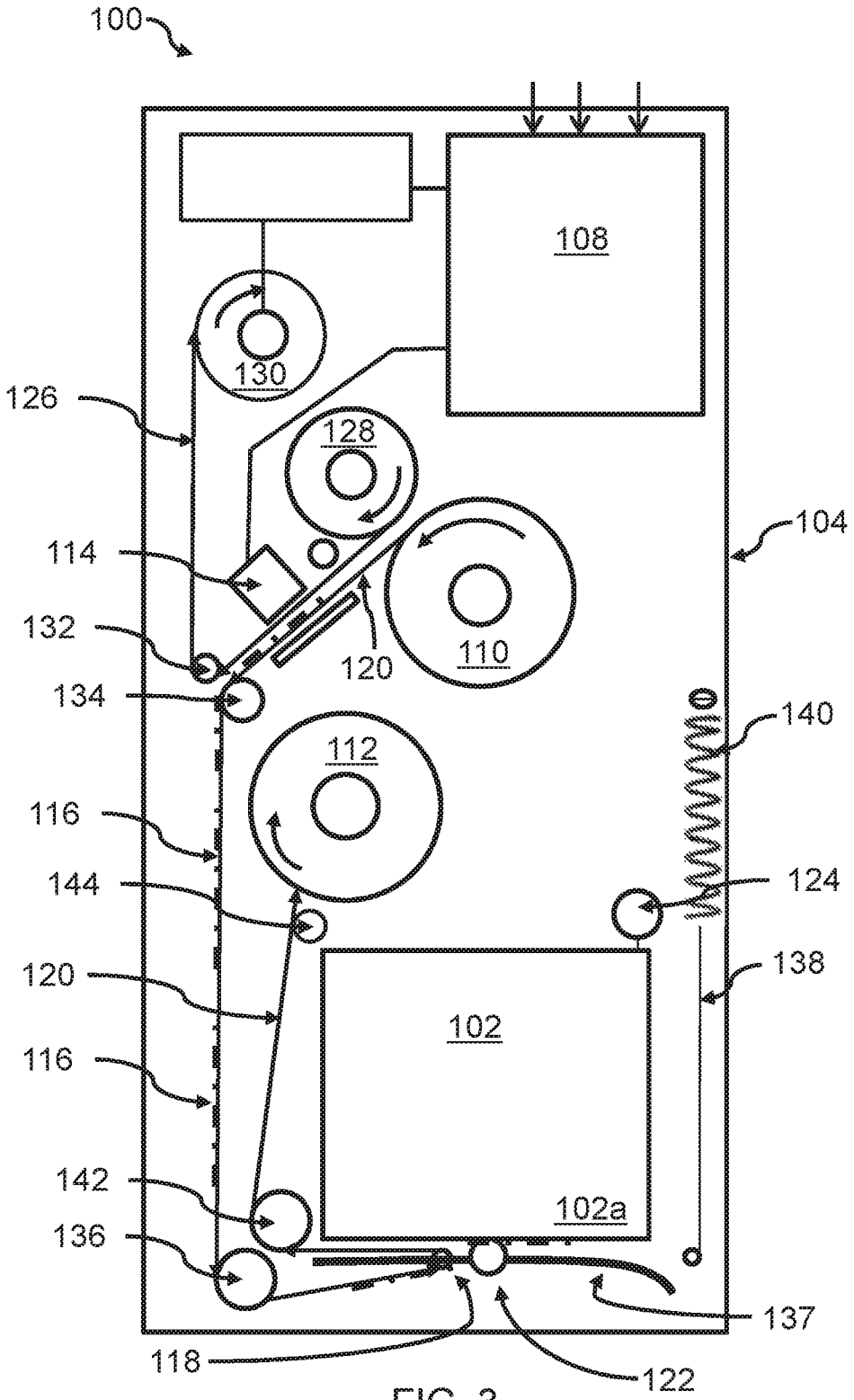
Figure 4:
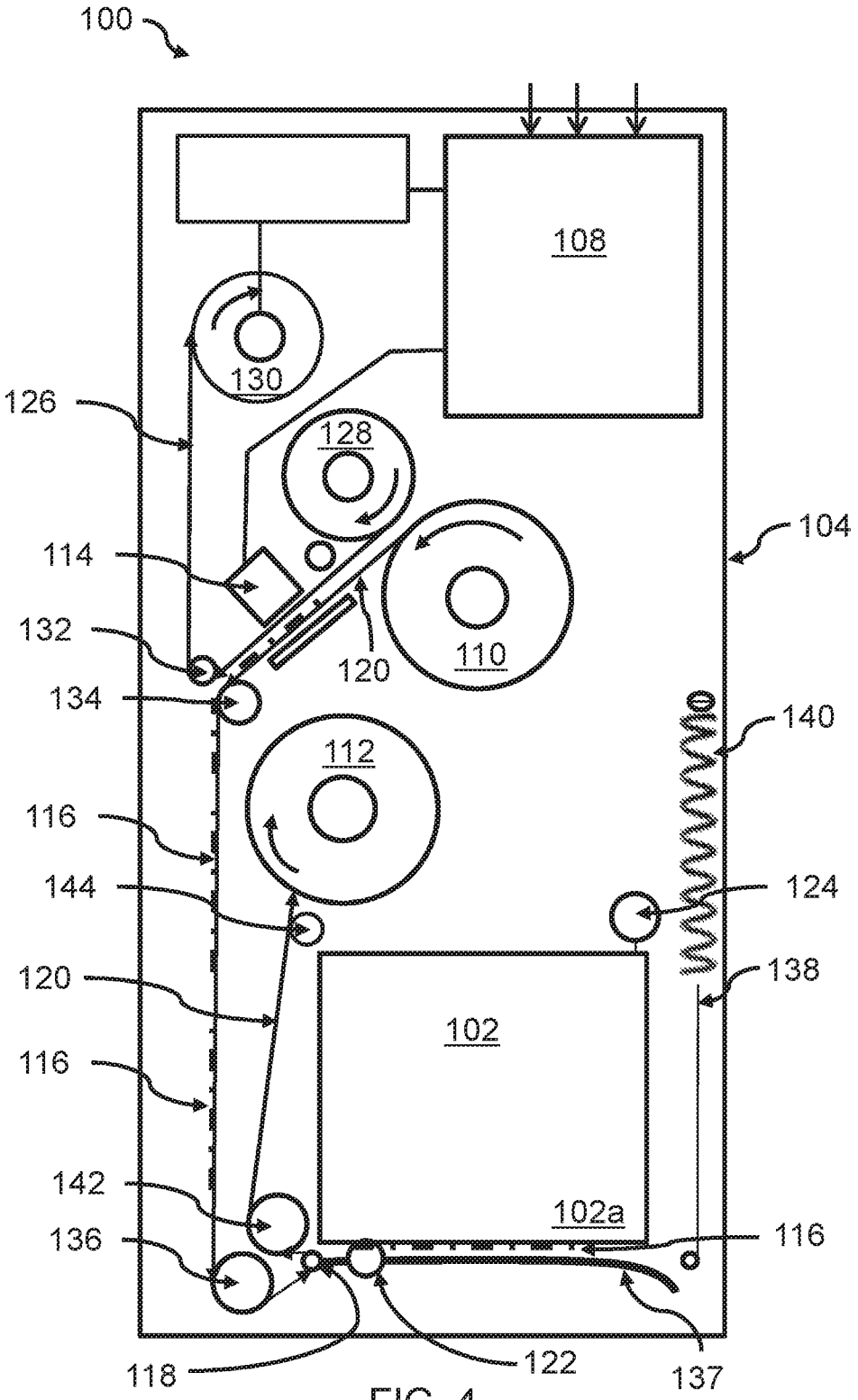
Figure 5:
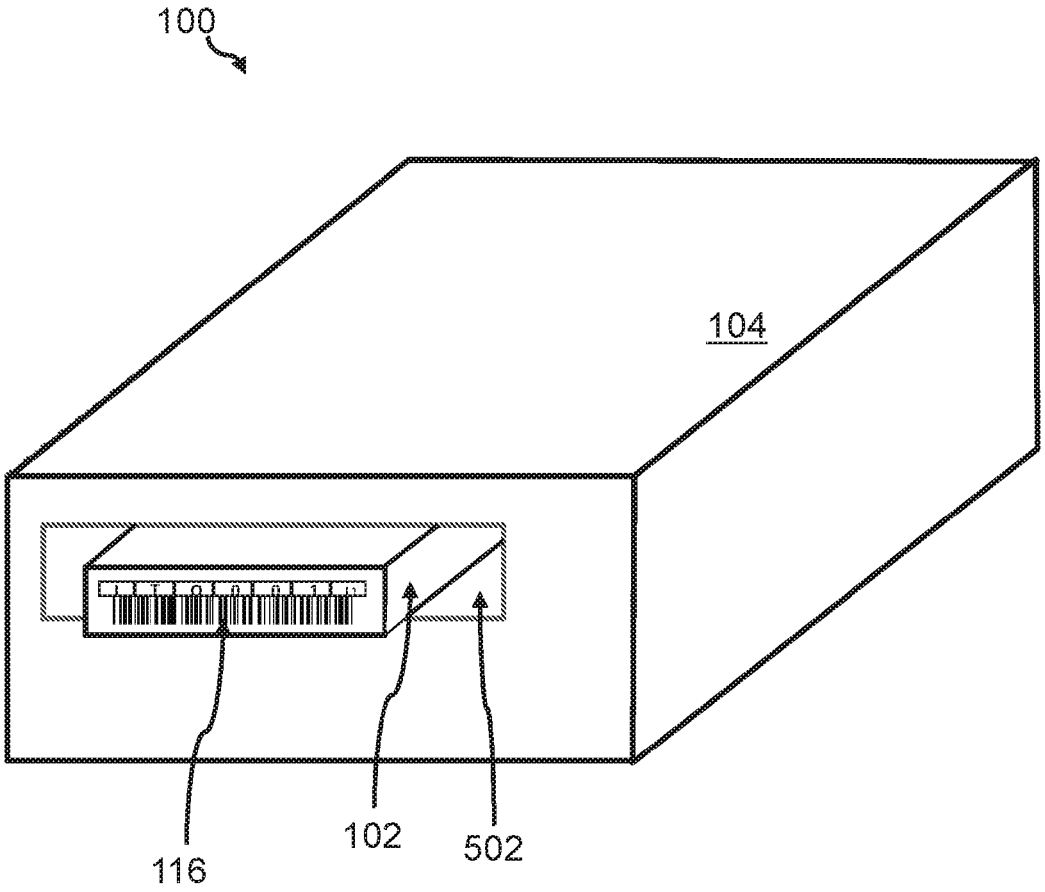
Figure 6:
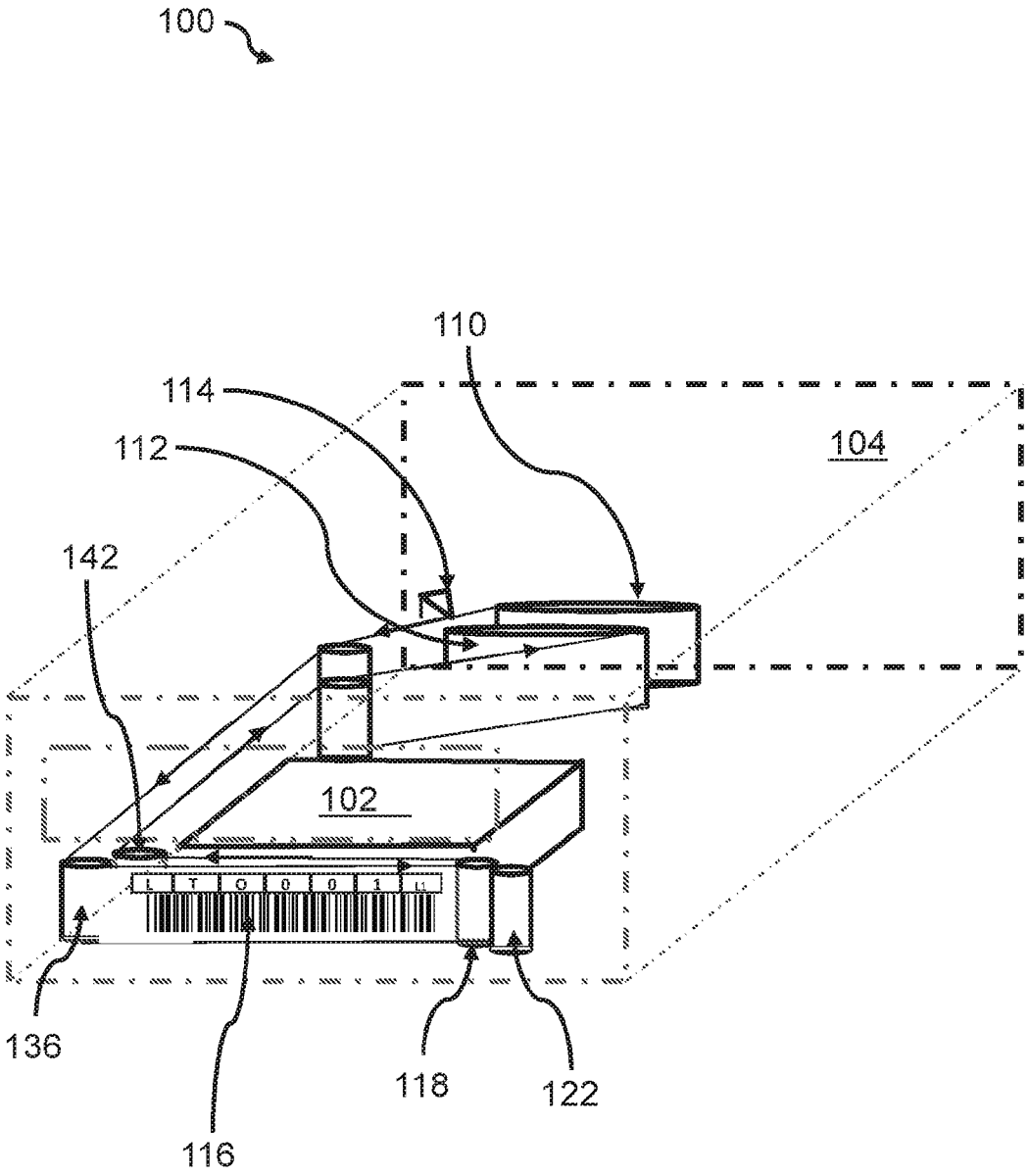
Figure 7:
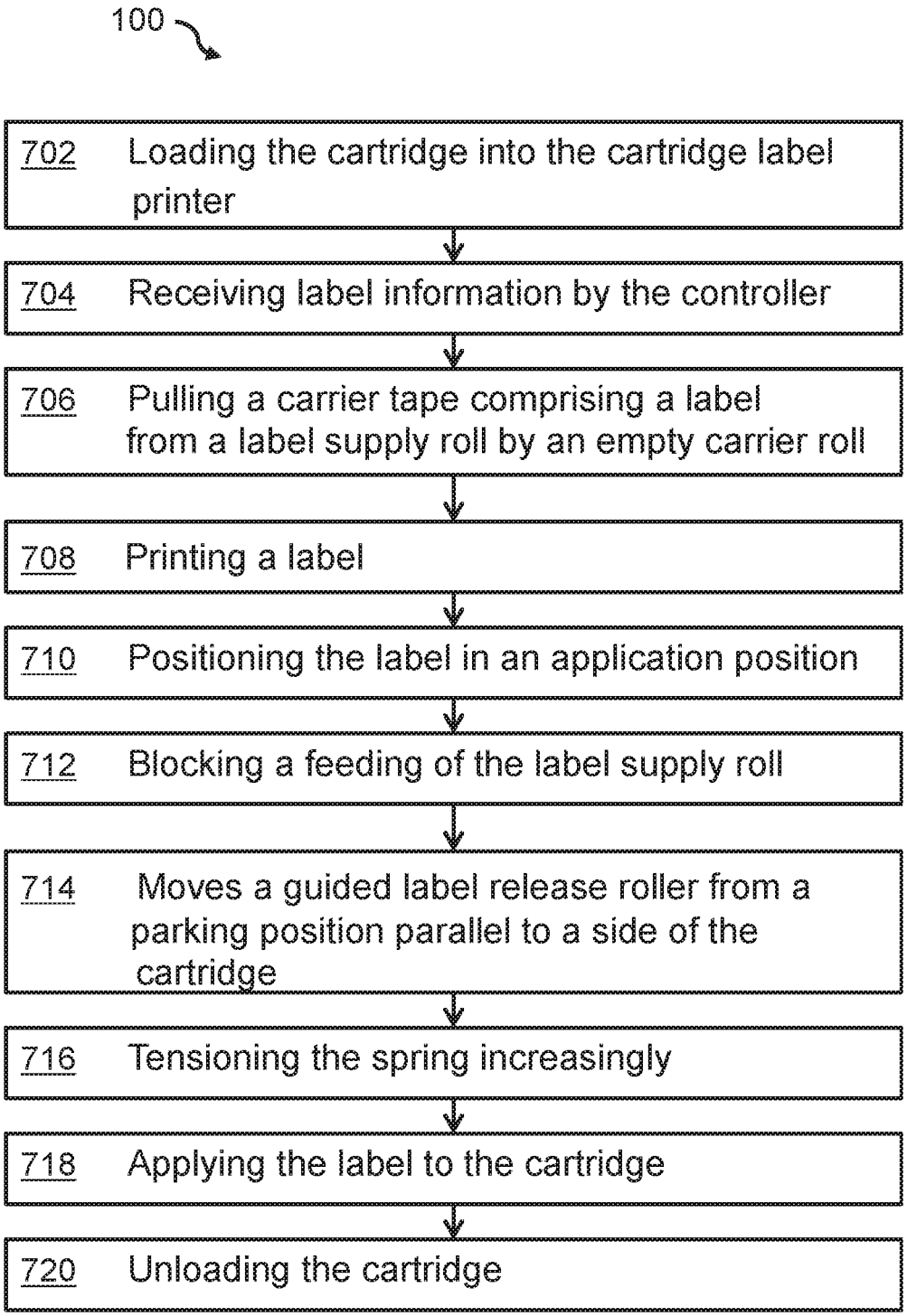
Figure 8:
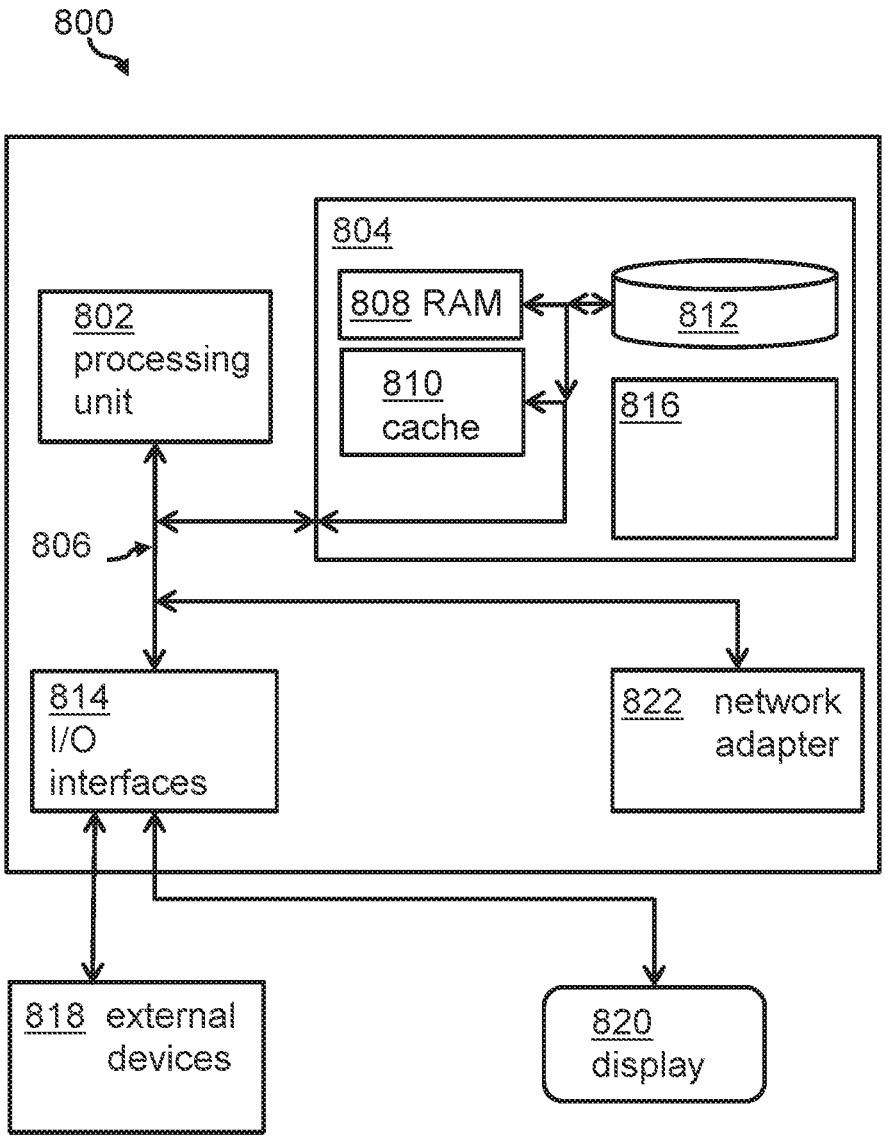

Embodiments of the invention will be described, by way of example only, and with reference to the following drawings:

FIG. 1 shows a block diagram of an embodiment of the inventive cartridge label printer for printing and applying a label to a cartridge;

FIG. 2 shows a block diagram of an embodiment of the cartridge label printer when the label application is starting;

FIG. 3 shows a block diagram of an embodiment of the cartridge label printer in an intermediate position;

FIG. 4 shows a block diagram of an embodiment of the cartridge label printer when the label application process ends;

FIG. 5 shows an embodiment of a cartridge label printer from the outside;

FIG. 6 shows a transparent perspective view to the cartridge label printer;

FIG. 7 shows an embodiment of a flowchart of the method for printing and applying a label to a cartridge; and FIG. 8 shows a computer system usable together with the cartridge label printer.

DETAILED DESCRIPTION

In the context of this description, the following conventions, terms and/or expressions may be used:

The term "label" may denote a piece of paper, cloth, or similar material that may be attached to something to identify or describe it. The label may have printed information on it.

The term "cartridge" may denote a standardized case or container that may be insertable into a machine such as a label printer or a tape drive, or a drive module, to apply a label to the cartridge. Here, the term may also denote a container used to enclose a storage medium such as a tape cartridge, comprising a magnetic tape.

The term "storage medium" may denote any storage medium like a magnetic tape, a magnetic disk, an optical disk, or the like. Although in the context of this description a magnetic tape may be the default assumption, other storage media may be possible.

The term "form factor" may denote physical dimensions of a housing or casing of a computer component, or storage component like a tape drive a hard drive, or the like. Form factor may also denote the form, position and location of electrical connectors in the housing as well as opening such as a load slot, e.g. for loading a cartridge into the computer component (for example, a tape drive).

The term "drive module" may denote a drive for reading and writing to a magnetic medium like a magnetic tape. The drive module may comprise all electrical and mechanical elements required to read and write from a tape while being connected to a computer system. The term "tape drive" may be a synonym for a drive module or, tape drive module.

The term "library system" may denote a storage device which may contain one or more tape drives, a number of slots to hold tape cartridges, a label reader to identify tape cartridges and an automated method for loading cartridges, e.g. a robot arm. Sometimes a library system may also be called a tape silo, tape robot or tape jukebox.

The term "cartridge load unit" may denote that portion of a drive module adapted for a reception of a cartridge through a slit or slot and position the cartridge into a location for a reliable read or write operation. Typically, the cartridge may be inserted into the housing of the drive module and moved in a vertical direction in order to fixate the cartridge. The cartridge load unit may also be adapted to unload the cartridge.

The term "label information" may denote data receivable by a cartridge label printer and/or its controller and which are printed onto a label in a human or machine-readable form. A machine-readable form may be, e.g. a barcode or a QR code (Quick Response Code). Other codes may be possible. Additionally, a combination of alphanumeric characters or any image and machine readable codes may be possible, e.g., QR codes.

The proposed cartridge label printer for printing and applying a label to a cartridge may offer multiple advantages and technical effects:

Firstly, the proposed cartridge label printer may be integrated into a tape library system without modifying the tape library system at all. The cartridge label printer may simply replace a drive module for reading and writing tapes and a cartridge. Because of identical mechanical and electrical connectors—i.e., the same form factor—and the cartridge label printer may behave like a standup drive module. The cartridge label printer may communicate using the same network protocol as a drive module of a tape library system. Thus, no modifications may be required to a standard tape library system.

Additionally, the labels may be positioned onto the cartridges in a much more reliable way in terms of orientation and position if compared to manually sticking the labels onto the cartridges by a user. The reliability of the positioning process may be dramatically increased. Always the same quality may be guaranteed which may increase the recognition of the printed information on the label by a human user or by an automatic pattern recognition system. It may be possible to re-label the cartridge if the code on an older label may fade out and may not be readable in a reliable manner.

It may also be possible to insert unlabeled cartridges into an import/export area—sometimes also called I/O area—of the tape library system, or in any other available slot of the tape library system. A detector in a picker or gripper may recognize that the cartridge may not carry a label and may feed the cartridge into the cartridge label printer inside the tape library system. No manual handling may be required at all. This may increase the reliability of the tape library system, and reduce operational costs, because no operator intervention may be required to apply labels to the cartridges.

Additionally, the cartridge label printer in one tape library system may also be usable by a second tape library system if the two tape library systems are connected by a pass-through mechanism that allows transfer of a cartridge from one tape library system to another one.

A further advantage may lie in the fact that labels applied to a cartridge are not touched by a human hand which may transfer acid or fat from the skin to the label which may have a negative effect on the durability and longevity of the label. Again, the reliability of the total tape library system may be increased, protecting made investments.

In the following paragraphs, further embodiments of the cartridge label printer and the related method are described.

According to one embodiment of the cartridge label printer, the cartridge is a tape cartridge and the storage medium may be a magnetic tape. However, other storage media are possible such as an optical disk, a mini disk, a DVD or the like. It may also be possible to include a hard drive or a memory module—in particular flash memory module—inside the cartridge.

According to one embodiment of the cartridge label printer, the label removal unit may comprise a movable, guided label release roller which may be held by a released spring in a parking position, and in which the guided label release roller may be movable parallel to a side of the cartridge while the label supply roll is blocked under a continuous pull of the empty carrier roll, such that the label may be released from the carrier tape. Thereby, the spring may increasingly be stretched and tensioned.

This mechanism allows for an easy peel-off of a sticky label from a carrier tape. It may be advantageous to select a label release roller having a dimension that may be small if compared to a longitudinal dimension of the label.

Alternatively, the label release roller may be guided by a linear motor moving an axis of the roller along a desired path. The linear motor may, e.g., be positioned below a chassis of the cartridge label printer.

According to one embodiment of the cartridge label printer, the spring may be linked to a guiding mechanism of the guided label release roller via a flexible wire, e.g., a steel wire. Advantageously, a deflector roll may be used in order to save mechanical space within the housing of the cartridge label printer.

According to one embodiment of the cartridge label printer, a curve-guided application roller is movable on an curved path—in particular, initially curved path—such that released portions of the label from the carrier tape are applied to the side of the cartridge. This way, the label, which may comprise a sticky backside, may be glued or stuck, or applied to an outside of the cartridge. Thus, the cartridge may get a unique identifier which may be human and/or machine readable.

The application roller and the label removal roller may be linked to each other at a fixed distance. The curved path of the curve-guided label application roller may lead to the guiding path of the label release roller.

In one embodiment, the cartridge label printer may comprise an empty label supply roll detector. Thus, if the label supply is depleted, an alarm may be triggered, an automated label supply roll switch may be performed, or a signal may be triggered in order that a spare cartridge label printer may take over responsibility for printing and applying the labels to the cartridges to be equipped with labels. This way, a continuous, uninterruptable operation may be guaranteed.

According to further embodiments of the cartridge label printer, different printing methods may be used together with the label printing device. The label printing device may comprise a printing head and the label printing device may be a printer for thermo-sensitive paper, a thermal printer using a thermal ink transfer belt, a laser printer, an inkjet printer, or a printer using an inked ribbon. Depending on the type of printing device, additional components may be required as part of the cartridge label printer, in particular, a transport unit for a thermal ink transfer belt, a color cartridge, or a transport unit for an inked ribbon. In case of a laser printer, also a toner box may be required. In case of an ink jet printer a color cartridge may be required. Thus, different printer options may be selected depending on available space, price, reliability, longevity, etc.

According to an embodiment of the method, the blocking the feeding of the label supply roll may be interrupted once the label is applied to a cartridge.

Additionally, pulling of the carrier tape by the empty carrier roll may be interrupted, in particular by stopping the movement of that empty carrier roll, whereby moving the guided label release roller may be moved back into its parking position. During this process, relaxing the spring. Thus, the movement of the guided label release roller may elegantly be caused by a tensioning of the carrier tape between the label supply roll and the empty carrier roll. The position, in which the label sticks on the carrier tape, may be fixed relative to a body or housing of the cartridge label printer as well as the cartridge. No further mechanical components may be required for a movement of the guided label release roller and the peeling-off the label from the carrier tape. As alternative to interrupt the feeding of the label supply roll, it may also be possible to let the label release roll turn backwards, and thus, let the guided release roller move back into its parking position.

According to one additionally preferred embodiment of the method, a next label may be printed while the guided label release roller is moving back into the parking position of the guided label release roller. During this process the carrier tape may continuously be fed. This may allow for a high throughput or printing and applying labels to cartridges.

According to another embodiment of the method, the application of a label to a cartridge may comprise moving a curve-guided application roller from a parking position on an initially—i.e. in the beginning of the path—curved path to an end position such that released portions of the label from the carrier tape may be applied to the side of the cartridge by pressing the label with the application roller against the cartridge. The sticky backside of the label may be instrumental in fixing the label to a defined position on the cartridge. An adjustable pressure from the curve-guided application roller may ensure that the label may be fixed permanently to the cartridge. The label release roller and the label application roller may partially use the same guiding track.

According to another embodiment of the method, the method may also comprise moving the curve-guided application roller from the end position to its parking position. This may be done before the guided label release roller has been moved back to its parking position and after the label has been applied to the cartridge. This may ensure that the curve-guided application roller and the guided label release roller may not require the same physical space for their movements. In case the distance between the label release roller and the label application roller is fixed, the two rollers would move back to their respective parking positions.

According to a further embodiment of the method, the label may be read—in particular by a detector of a picker or gripper of a tape library—after the label has been applied to the cartridge with the received label information. This may allow for a closed loop quality verification process. Because the label on the cartridge may be used for an unmistakable identification, a failure to read the label by the detector may require some additional action in order to ensure a correct identification of cartridges. Different actions may be triggered: an alarm or error message may be generated, the cartridge may be sorted out, and/or a new label may be printed and applied over the already existing label.

In the following paragraphs, a detailed description of the figures will be given. All illustrations in the figures are schematic. Firstly, a block diagram of an embodiment of the present invention cartridge label printer for printing and applying a label to a cartridge is given. Afterwards, further embodiments, as well as embodiments of the method for operating a cartridge label printer for printing and applying a label to a cartridge will be described.

FIG. 1 shows a block diagram of an embodiment of cartridge label printer 100 for printing and applying a label to a cartridge 102 comprising a storage medium. The storage medium may be, e.g., a magnetic tape. Cartridge label printer 100 comprises a housing 104 having a form factor and electrical connectors 106 identical to a drive module of a library system. The drive module may typically be used for reading and writing magnetic tapes and they may typically be used by a tape library system as known in the art. The electrical connectors 106 may typically be used for a data interface—e.g., a network interface and/or library system interface—as well as for power supply.

Cartridge label printer 100 may additionally comprise a controller 108 with controlling functions for the cartridge label printer. Input signals of the controller 108 may be compatible with a communication protocol of the drive module. A cartridge load unit (not shown) may also have identical functions if compared to the drive module. Thus, the mechanics of the cartridge load unit of the drive module may also be used for cartridge label printer 100. This way, also the controlling functions of the controller 108 for moving the cartridge 102 into a secured position within cartridge label printer 100 may be reused from a drive module. A motor 124 may be instrumental in achieving a movement in a z-direction if the plane of FIG. 1 is assumed to be in the x- and y-directions.

Cartridge label printer 100 may also comprise a label supply roll 110 comprising individual labels on a carrier tape, an empty carrier tape reception roll 112, as well as a label printing device adapted for printing a code on the label 116. This may be a print head of a typical printer, as already mentioned above. Furthermore, cartridge label printer 100 comprises a carrier tape transport unit—in particular the sum of all rollers, guides and motors required to turn the rolls, in particular the empty carrier tape reception roll and/or the label supply roll and/or brake or blocking systems. Additionally, rolls or wheels for a transfer ribbon and related motors may be denoted as carrier tape transport unit.

Cartridge label printer 100 may also comprise a label removal unit 118—also denoted as guided label release roller 118—adapted for a removal of a label 116 from the carrier tape 120, and a label application unit in form of a curve-guided application roller 122 adapted for applying the label 116 to the cartridge 102.

Furthermore, FIG. 1 shows a thermal ink carrier tape 126 and a related supply wheel 128, a roller 132 and an empty carrier tape wheel 130. However, other printing technologies may be used to print labels 116 onto the carrier tape 120. The thermal ink carrier tape 126 may be driven by synchronized stepper motors (not shown) below the supply wheel 128 or supply roll and the empty carrier tape wheel 130 or empty carrier tape roll. The transportation of the thermal ink carrier tape 126 is synchronized with the printing of codes—e.g., in the form of barcodes—to the labels 116 by the printer head 114.

In operation, the labels 116 are supplied from the label supply roll 110, and guided in front of the printer head 114 and guided via rollers 134 and 136 to the front of the cartridge 102. The next roller, namely, the guided label release roller 118, which is mounted onto a sliding curved guide 136, functions to release the printed label 116 by bending the carrier tape 120 with the label over a small radius roller, namely the guided label release roller 118 such that the label is released from the carrier tape while the tape is moving past the release roller. The guided label release roller 118 and the curve-guided label application roller 122 may be forced back to the shown position—in particular a parking position—by a flexible steel wire 138 and a spring 140 used to provide tension to the sliding rollers. The empty carrier tape 120*a* passes over the rollers 142 and 144 and wound up by using the empty carrier tape reception roll 112. Typically, the wheels and rolls are driven by stepper motors.

The process of labeling a cartridge 102 starts with loading the cartridge into a slit in the housing of cartridge label printer 100. Once cartridge 102 has been received, a confirmation message is generated to signal that a cartridge 102 is seated into the load position and ready for receiving a label 116.

In parallel, label information may be requested via the connectors 106—e.g., from a tape library system—and the controller 108. By default, a next consecutive label value may be used. Alternatively, a dedicated single label value or a list of label values may be received to be sequentially applied via the interface connectors 106, in particular, a network interface. Again alternatively, a third option is to receive a single label value or list of label values to be sequentially applied from an operator panel—e.g., an operator panel of a tape library system—or a library web interface.

In a next step, the printer head 114 is instructed to print the received label value to a label 116. For this purpose, the controller moves an empty label from the label supply roll 110 using a stepper motor driving the label supply roll 110, wherein the stepper motor is synchronously aligned with the motor driving the empty carrier tape reception roll 112. This may allow a precise positioning of the label for printing, transporting, and applying the label 116 to the cartridge 102. Because the label supply roll 110 and the empty carrier tape reception roll 112 are moved synchronously—also reflecting a film carrier tape level of the label supply roll 110 and the empty carrier tape reception roll 112—the force of the spring 114 holds the guided label release roller 118 and the label application roller 122 in the respective parking position in the lower edge 102*a* of the cartridge 102. This way, a new printed label 116 may be positioned exactly in front of the cartridge 102 to which the label may be applied.

FIG. 2 shows a block diagram of an embodiment of cartridge label printer 100 when the label application is starting. If the printed label 116 is in the application position, the label application cycle starts by stopping the label supply roll 110, while at the same time the empty carrier tape reception roll 112 continues to wind up the carrier tape 120. The printer and motor controller 146 generates the required signals for all the stepper motors as well as the printer head 114. The print and motor controller 146 are linked to the controller 108. This way, the carrier tape 120 is pulled and forces the label release roller 118 and the label application roller 122 moving more and more parallel to the side of the cartridge 102 facing the carrier tape 120. The label release roller 118 and the label application roller 122 are guided by the curved slider 137. With this, the extension of the spring 140—via the wire 138—is providing an increasing pullback force to the sliding mechanism of the two rollers 118 and 122. By this movement the label 116 at the bottom of FIG. 1 releases or peels itself from the carrier tape 120, while the label application roller 122 follows the slider 136.

By this movement, the label application roller 122 is pressed towards the released label 116, such that the sticky back side of the label 116 is applied to the cartridge 102.

FIG. 3 shows a block diagram of an embodiment of cartridge label printer 100 when the label application is in mid-cycle.

FIG. 4 shows a block diagram of an embodiment of cartridge label printer 100 when the label application roller 122 has reached the end of the label 116. Then, a repositioning of the label release roller 118 and the label application roller 122 starts to bring the two rollers back into their parking position on the bottom left side of the figure. This is achieved by stopping the pulling of the empty carrier tape reception roll 112 and reversing its turning direction by the related stepper motor. Due to the force of the spring 114 the label release roller 118 and the label application roller 122 are pulled back into their related parking positions close to the corner 102*a* of the cartridge 102.

As a result, the label 116 has been applied to the cartridge 102 and the cartridge 102 may be unloaded from cartridge label printer 100 using the motor 124.

FIG. 5 shows a block diagram of an embodiment of a cartridge label printer 100. The cartridge label printer has a housing 104 like a typical tape drive module, i.e., a shape and physical dimensions (same form factor) as a typical drive module of a tape library system. Additionally, the cartridge label printer comprises a slot 502 for receiving a cartridge 102. Behind the slot, the cartridge load unit—with identical functions if compared to a tape drive module—may receive the cartridge to be labeled. The load unit may also function as an unload unit once the label 116 has been applied to the cartridge 102. The label 116 may be directed to the front of the cartridge so that a recognition system of a gripper of a tape robot is enabled to read the code printed on the label 116.

FIG. 6 shows a transparent perspective view to the cartridge label printer. The cartridge 102 has been loaded into an active printing position for applying the label 116 to the cartridge 102. The guided label release roller 118, as well as the curve-guided application roller 122, are shown in the bottom right corner of FIG. 7. The housing 104 is shown having a semitransparent appearance. The guiding roller 136 guiding the carrier tape with the label 116 to the applying position is shown as well as the roller 142 guiding the carrier label to the empty carrier tape reception roll 112. Also the print head 114 as well as the label supply roll 110 are shown.

FIG. 7 shows an embodiment of a flowchart of the method 700 for printing and applying a label to a cartridge. The cartridge comprises a storage medium. The method comprises: loading, 702, the cartridge into the cartridge label printer; (ii) receiving, 704, label information by the controller; pulling, 706, a carrier tape comprising a label from a label supply roll by an empty carrier roll (thereby, information according to the received label information is printed 708 by passing the label on the carrier tape over a print head. The method further comprises: positioning, 710, the label in an application position relative to the cartridge by continuously pulling by the empty carrier roll, and blocking, 712, a feeding of the label supply roll (meaning the supply roll is held stationary, that is, prevented from rotating), once the label is in the application position. Thereby, the carrier tape moves, 714, a guided label release roller from a parking position parallel to a side of the cartridge. This way, the spring is increasingly tensioned, 716, such that the label is released from the carrier tape.

Then, the label is applied, 718, to the cartridge, and the cartridge is unloaded, 720, from cartridge label printer 100. The cartridge label printer may then be picked by a gripper of a tape library system (not shown).

Embodiments of the invention may be implemented together with virtually any type of computer, regardless of the platform, being suitable for storing and/or executing program code. A computer for supporting an operation the tape library system may itself be part of the tape library system. FIG. 8 shows, as an example, such a computing system 800.

The computing system 800 is only one example of a suitable computer system and is not intended to suggest any limitation as to the scope of use or functionality of embodiments of the invention described herein. Regardless, computer system 800 is capable of being implemented and/or performing any of the functionality set forth hereinabove. In the computer system 800, there are components, which are operational with numerous other general purpose or special purpose computing system environments or configurations. Examples of well-known computing systems, environments, and/or configurations that may be suitable for use with computer system/server 800 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like. Computer system/server 800 may be described in the general context of computer system-executable instructions, such as program modules, being executed by a computer system 800. Generally, program modules may include routines, programs, objects, components, logic, data structures, and so on that perform particular tasks or implement particular abstract data types. Computer system/server 800 may be practiced in distributed cloud computing environments where tasks are performed by remote processing devices that are linked through a communications network. In a distributed cloud computing environment, program modules may be located in both local and remote computer system storage media including memory storage devices.

As shown in the figure, computer system/server 800 is shown in the form of a general-purpose computing device. The components of computer system/server 800 may include, but are not limited to, one or more processors or processing units 802, a system memory 804, and a bus 806 that couples various system components including system memory 804 to the processor 802. Bus 806 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus. Computer system/server 800 typically includes a variety of computer system readable media. Such media may be any available media that is accessible by computer system/server 800, and it includes both, volatile and non-volatile media, removable and non-removable media.

The system memory 804 may include computer system readable media in the form of volatile memory, such as random access memory (RAM) 808 and/or cache memory 810. Computer system/server 800 may further include other removable/non-removable, volatile/non-volatile computer system storage media. By way of example only, storage system 812 may be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media may be provided. In such instances, each can be connected to bus 806 by one or more data media interfaces. As will be further depicted and described below, memory 804 may include at least one program product having a set (e.g., at least one) of program modules that are configured to carry out the functions of embodiments of the invention.

Program/utility 814, having a set (at least one) of program modules 816, may be stored in memory 804 by way of example, and not limitation, as well as an operating system, one or more application programs, other program modules, and program data. Each of the operating system, one or more application programs, other program modules, and program data or some combination thereof, may include an implementation of a networking environment. Program modules 816 generally carry out the functions and/or methodologies of embodiments of the invention as described herein.

The computer system/server 800 may also communicate with one or more external devices 818 such as a keyboard, a pointing device, a display 820, etc.; one or more devices that enable a user to interact with computer system/server 800; and/or any devices (e.g., network card, modem, etc.) that enable computer system/server 800 to communicate with one or more other computing devices. Such communication can occur via input/output (I/O) interfaces 814. Still yet, computer system/server 800 may communicate with one or more networks such as a local area network (LAN), a general wide area network (WAN), and/or a public network (e.g., the Internet) via network adapter 822. As depicted, network adapter 822 may communicate with the other components of computer system/server 800 via bus 806. It should be understood that although not shown, other hardware and/or software components could be used in conjunction with computer system/server 800. Examples, include, but are not limited to: microcode; device drivers; redundant processing units; external disk drive arrays; RAID systems; tape drives; and data archival storage systems, etc.

The descriptions of the various embodiments of the present invention have been presented for purposes of illustration, but are not intended to be exhaustive or limited to the embodiments disclosed. Many modifications and variations will be apparent to those of ordinary skills in the art without departing from the scope and spirit of the described embodiments. The terminology used herein was chosen to best explain the principles of the embodiments, the practical application or technical improvement over technologies found in the marketplace, or to enable others of ordinary skills in the art to understand the embodiments disclosed herein.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A cartridge label printer for printing and applying a label to a cartridge comprising a storage medium, the cartridge label printer comprising:

a housing having a form factor and electrical connectors respectively identical to a form factor and electrical connectors of a drive module of a library system;

a controller with controlling functions of the cartridge label printer, wherein the controller is compatible with a communication protocol of the drive module;

a cartridge load unit which accepts a cartridge into the cartridge label printer;

a label supply roll comprising individual labels on a carrier tape;

an empty carrier tape reception roll;

a label printing device adapted for printing a code on the label;

a carrier tape transport unit;

a label removal unit adapted for a removal of a label from the carrier tape; and a label application unit adapted for applying the label to the cartridge.

2. The cartridge label printer according to claim 1, wherein:

the cartridge is a tape cartridge; and the storage medium is a magnetic tape.

3. The cartridge label printer according to claim 1, wherein the label removal unit comprises a movable, guided label release roller which is held by a released spring in a parking position; and the guided label release roller is movable parallel to a side of the cartridge while the label supply roll is blocked under a continuous pull of the empty carrier roll, such that the label is released from the carrier tape, whereby the spring is increasingly tensioned.

4. The cartridge label printer according to claim 3, wherein:

the spring is linked to a guiding mechanism of the guided label release roller via a flexible wire.

5. The cartridge label printer according to claim 3, wherein a curve-guided application roller is movable on a curved path such that released portions of the label from the carrier tape are applied to the side of the cartridge.

6. The cartridge label printer according to claim 1, wherein a backside of the label is sticky.

7. The cartridge label printer according to claim 1, further comprising an empty label supply roll detector.

8. The cartridge label printer according to claim 1, wherein the label printing device is one selected out of the group consisting of: a thermal printer using thermo-sensitive paper; a thermal printer using a thermal ink transfer belt; a laser printer; an inkjet printer; and a printer using an inked ribbon.

9. The cartridge label printer according to claim 1, further comprising:

a transport unit for a thermal ink transfer belt;

a color cartridge; and a transport unit for an inked ribbon.

10. A method for operating a cartridge label printer for printing and applying a label to a cartridge comprising a storage medium, the method comprising:

loading the cartridge into the cartridge label printer;

receiving label information by a controller;

pulling a carrier tape comprising a label from a label supply roll by an empty carrier roll, thereby printing information according to the received label information by passing the label on the carrier tape over a print head;

positioning the label in an application position relative to the cartridge by continuously pulling by the empty carrier roll;

blocking a feeding of the label supply roll, once the label is in the application position, whereby the carrier tape moves a guided label release roller from a parking position parallel to a side of the cartridge, thereby increasingly tensioning the spring such that the label is released from the carrier tape;

applying the label to the cartridge; and unloading the cartridge from the cartridge label printer.

11. The method according to claim 10, wherein:

the blocking of the feeding of the label supply roll is interrupted once the label is applied to the cartridge; and interrupting the pulling of the carrier tape by the empty carrier roll, thereby moving the guided label release roller back into its parking position and increasingly relaxing the spring.

12. The method according to claim 10, wherein a next label is printed while the guided label release roller is moving back into the parking position of the guided label release roller.

13. The method according to claim 10, wherein applying the label to the cartridge further comprises moving a curve-guided application roller from a parking position on a curved path to an end position such that released portions of the label from the carrier tape are applied to the side of the cartridge by pressing the label with the application roller against the cartridge.

14. The method according to claim 13, further comprising moving the curve-guided application roller from the end position to its parking position after the label has been applied to the cartridge.

15. The method according to claim 10, wherein the label is read after the label has been applied to the cartridge with the received label information.

* * * * *